US008387543B2

(12) United States Patent
Mallon

(10) Patent No.: US 8,387,543 B2
(45) Date of Patent: Mar. 5, 2013

(54) EXTENDABLE TABLE FOR USE WITH AN OUTDOOR UMBRELLA

(76) Inventor: Timothy Mallon, Mahopac, NY (US)

( * ) Notice: Subject to any disclaimer, the term of this patent is extended or adjusted under 35 U.S.C. 154(b) by 0 days.

(21) Appl. No.: 13/235,441

(22) Filed: Sep. 18, 2011

(65) Prior Publication Data

US 2012/0067252 A1 Mar. 22, 2012

Related U.S. Application Data

(60) Provisional application No. 61/384,977, filed on Sep. 21, 2010.

(51) Int. Cl.
*A47B 37/00* (2006.01)

(52) U.S. Cl. ..... 108/50.12; 135/16

(58) Field of Classification Search ..... 108/84, 108/85, 50.12, 25, 90, 20; 135/16
See application file for complete search history.

(56) References Cited

U.S. PATENT DOCUMENTS

| | | | | |
|---|---|---|---|---|
| 1,584,621 | A * | 5/1926 | Murdo | 108/83 |
| 1,861,565 | A * | 6/1932 | Hall | 108/84 |
| 2,079,225 | A * | 5/1937 | Sabaneeff | 108/96 |
| 5,421,271 | A * | 6/1995 | Sui | 108/50.02 |
| 5,775,315 | A * | 7/1998 | Baykal | 126/25 R |
| 6,065,466 | A * | 5/2000 | Baykal | 108/50.12 |
| 6,698,363 | B2 | 3/2004 | Mallon | |
| 8,116,497 | B2 * | 2/2012 | Li | 135/16 |
| 8,161,891 | B2 * | 4/2012 | Palese | 135/16 |
| 8,166,893 | B2 * | 5/2012 | Davis | 108/90 |
| 2007/0012226 | A1 * | 1/2007 | Chen | 108/86 |
| 2009/0120477 | A1 * | 5/2009 | Li | 135/16 |
| 2009/0165681 | A1 * | 7/2009 | Smith et al. | 108/50.12 |
| 2009/0196020 | A1 * | 8/2009 | Tsai | 135/16 |

* cited by examiner

*Primary Examiner* — Jose V Chen
(74) *Attorney, Agent, or Firm* — Law Offices of Michael L. Wise, LLC

(57) ABSTRACT

An extendable table comprises a frame, a table top portion, and a cutout filling mechanism. The table top portion is slidably attached to the frame and defines a cutout. The cutout filling mechanism is attached to the table top portion and comprises a filler portion. In use, the cutout filling mechanism is operative to place at least a portion of the filler portion into the cutout when the cutout is not occupied by another object. The cutout filling mechanism is also operative to place the filler portion outside the cutout when the cutout is occupied by another object.

15 Claims, 7 Drawing Sheets

Fig. 7
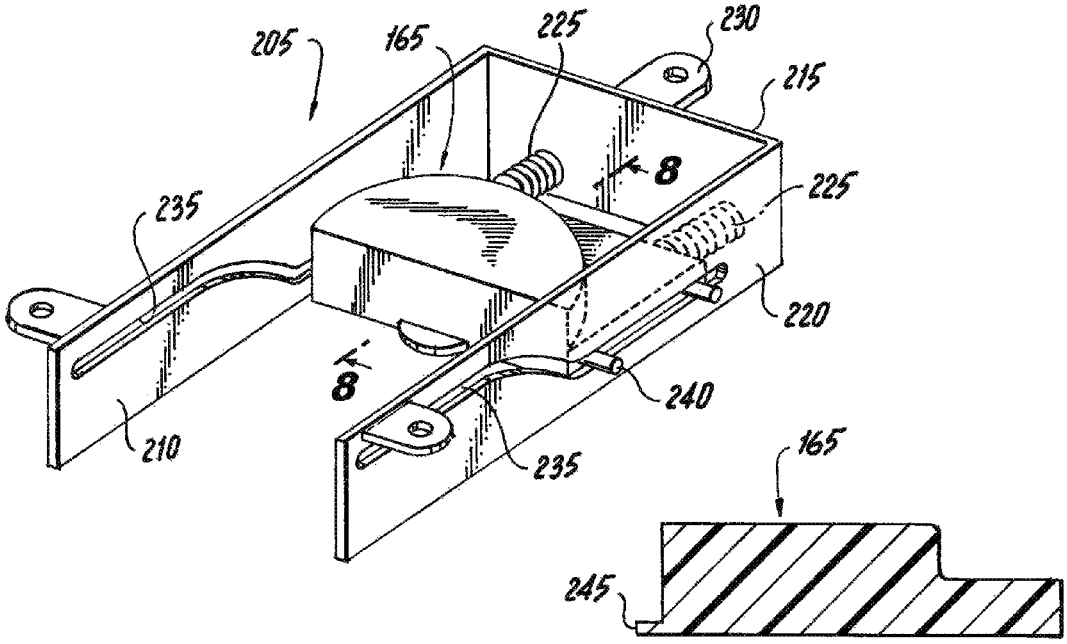
Fig. 8
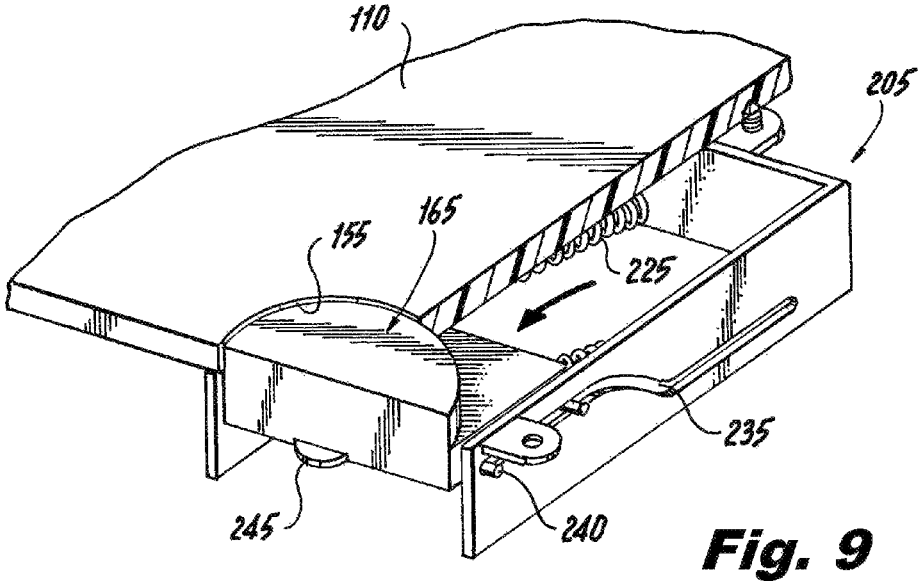
Fig. 9

EXTENDABLE TABLE FOR USE WITH AN OUTDOOR UMBRELLA

FIELD OF THE INVENTION

The present invention relates generally to furniture, and, more particularly, to extendable tables.

BACKGROUND OF THE INVENTION

During the warm months, it is often desirable to sit under a large outdoor umbrella (sometimes called a "patio umbrella") when seated outdoors. As a result, many outdoor tables are adapted for such umbrellas by including an umbrella mounting hole that passes through the tables near their centers. With such a mounting hole, a user is able to pass the pole of the outdoor umbrella through a table and anchor it into a heavy base that sits on the ground beneath the table.

Even so, it has always been difficult to accommodate an umbrella mounting hole in an extendable table. An extendable table typically includes two slidable table top portions that may be abutted against one another in order to close or contract the table, and separated from each other in order to make room for one or more additional table leaves. Accordingly, it is desirable that the slidable table tops have cutouts that collectively define a mounting hole for an outdoor umbrella when the table is contracted. Nevertheless, it is equally undesirable that the slidable table tops have these same cutouts when the table is extended. When the table is extended, the cutouts merely create extraneous and unsightly openings in the extended table top.

For the foregoing reasons, there is a need for new extendable table designs better adapted to accommodate outdoor umbrellas.

SUMMARY OF THE INVENTION

Embodiments of the present invention address the above-identified need by providing extendable table designs adapted to accommodate outdoor umbrellas without suffering from extraneous and unsightly openings in the tables when the tables are extended.

In accordance with an aspect of the invention, an extendable table comprises a frame, a table top portion, and a cutout filling mechanism. The table top portion is slidably attached to the frame and defines a cutout. The cutout filling mechanism is attached to the table top portion and comprises a filler portion. In use, the cutout filling mechanism is operative to place at least a portion of the filler portion into the cutout when the cutout is not occupied by another object. The cutout filling mechanism is also operative to place the filler portion outside the cutout when the cutout is occupied by another object.

Advantageously, the above-identified embodiments of the invention work to fill-in or "erase" the cutouts in the table top portions of an extendable table when they are not needed to accommodate a central pipe member or umbrella pole.

BRIEF DESCRIPTION OF THE DRAWINGS

These and other features, aspects, and advantages of the present invention will become better understood with regard to the following description, appended claims, and accompanying drawings where:

FIG. 7 shows a perspective view of the FIG. 5 cutout filling mechanism;

FIG. 8 shows a sectional view of the filler portion in the FIG. 5 cutout filling mechanism;

FIG. 9 shows another perspective view of the FIG. 5 cutout filling mechanism;

DETAILED DESCRIPTION OF THE INVENTION

The present invention will be described with reference to illustrative embodiments. For this reason, numerous modifications can be made to these embodiments and the results will still come within the scope of the invention. No limitations with respect to the specific embodiments described herein are intended or should be inferred.

Figure 1:
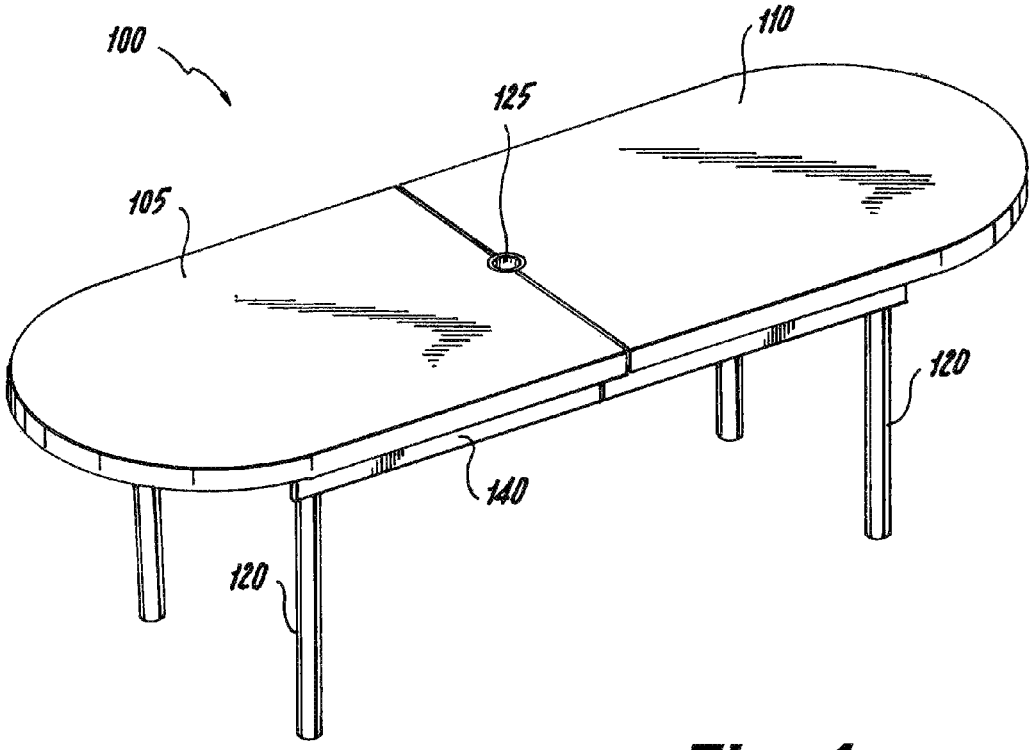
FIG. 1 shows a perspective view of an extendable table in accordance with a first illustrative embodiment of the invention.
Figure 2:
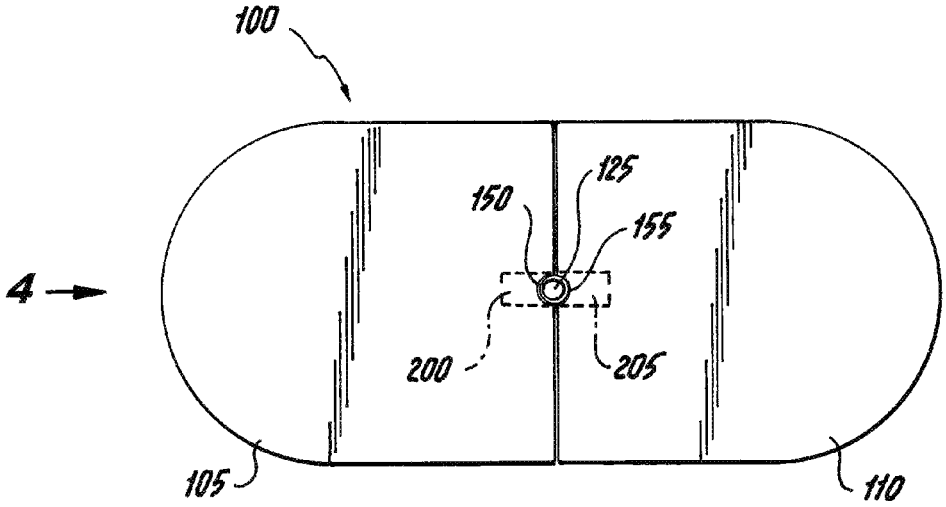
FIG. 2 shows a plan view of the FIG. 1 extendable table in its contracted state.
Figure 3:
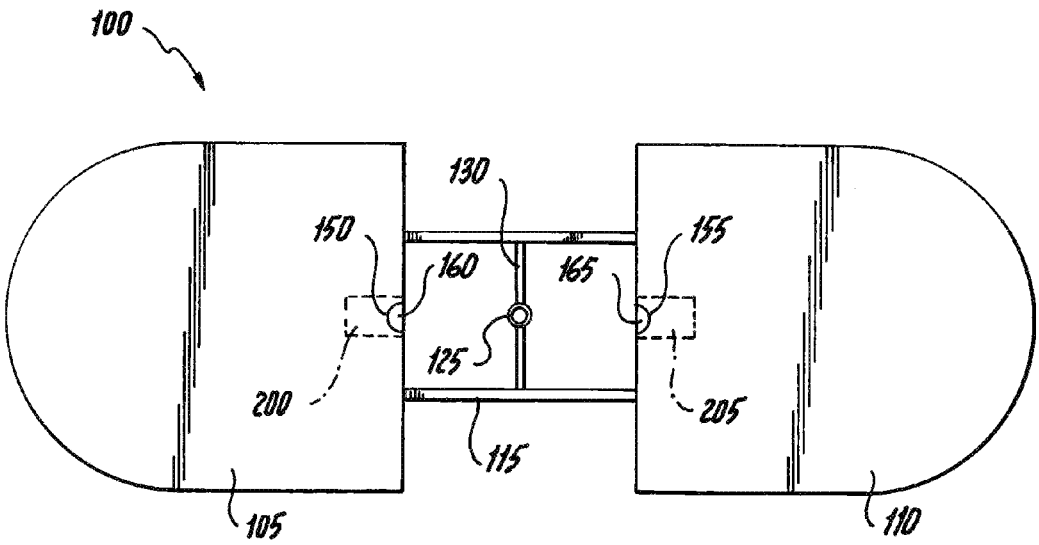
FIG. 3 shows a plan view of the FIG. 1 extendable table in its extended state.

FIGS. 1-3 show an extendable table 100 in accordance with a first illustrative embodiment of the invention. More particularly, FIGS. 1 and 2 show a perspective view and a plan view, respectively, of the extendable table 100 while in its closed or contracted state, while FIG. 3 shows a plan view of the extendable table 100 while the extendable table 100 is in its extended state. Once extended as shown in FIG. 3, the extendable table 100 can accommodate one or more table leaves that effectively act to fill in the gap between the table top portions and create one continuous table top.

The extendable table 100 comprises two table top portions 105 and 110, a frame 115, four legs 120, and a pipe member 125. The two table top portions 105, 110 are slidably mounted to the frame 115 so that they can be positioned so they abut one another (contracted state) and so they are separated by a substantial gap (extended state). The pipe member 125, in turn, is formed by a vertically oriented cylindrical tube that is attached to the frame 115 by a pair of support brackets 130 (observable in FIG. 3). This manner of support allows the pipe member 125 to remain centered in the extendable table 100 independent of the positions of the table top portions 105, 110. The cylindrical shape of the pipe member 125 allows the pole of an umbrella to pass through the pipe member 125, where it can be anchored into a conventional umbrella base (not shown) that is positioned below the extendable table 100 or by another means (described below).

Figure 4:
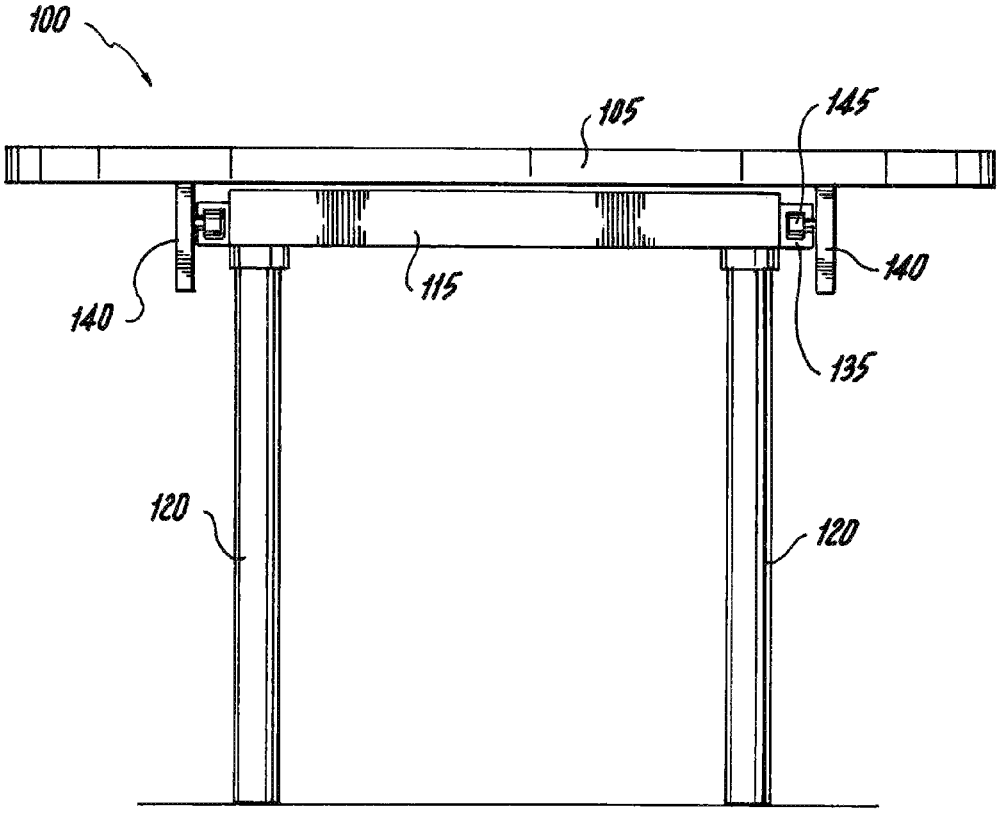
FIG. 4 shows an end view of the FIG. 1 extendable table.

The means by which the table top portions 105, 110 are slidably attached to the frame 115 are best seen in FIG. 4, which shows an end view of the extendable table 100. The frame 115 includes rails 135 that extend generally parallel to each other along the length of the extendable table 100 between the pairs of legs 120. Each table top portion 105, 110 includes a respective set of support members 140 that are attached to the bottom of the table top portions 105, 110. Rollers 145 are rotatably attached to the support members 140 and are engaged within the rails 135, thereby allowing each table top portion 105, 110 to easily slide along the frame 115 while the frame 115 and legs 120 remain stationary.

Again referring to FIGS. 1-3, it will be observed that each of the table top portions 105, 110 has a respective end closest to the pipe member 125 that defines a respective semicircular cutout 150 and 155. In fact, the cutout 150 in the table top portion 105 is substantially a mirror image of and complementary to the cutout 155 in the table top portion 110. These two cutouts 150, 155 allow the pipe member 125 to exist between the table top portions 105, 110 when the extendable table 100 is in its contracted state. In this state, the pipe member 125 fills in, and is substantially surrounded by, the cutouts 150, 155 when the two table top portions 105, 110 are positioned to be abutting (FIGS. 1 and 2). In contrast, when the table top portions 105, 110 are separated (FIG. 3), the pipe member 125 remains centered in the extendable table 100 and the cutouts 150, 155 no longer need to accommodate the pipe member 125. Under these conditions, the cutouts 150, 155 take on a substantially different condition. More precisely, the cutouts 150, 155 are occupied by respective filler portions 160 and 165. The filler portions 160, 165 substantially fill the cutouts 150, 155 and even provide an upper surface that is substantially flush with the upper surface of the table top portions 105, 110. In this manner, the cutouts 150, 155 are effectively "erased" when viewed from above while the extendable table 100 is in its extended state.

In the present illustrative embodiment, the filling of the cutouts 150, 155 in the table top portions 105, 110 when the extendable table 100 is extended is accomplished by two cutout filling mechanisms 200 and 205. As indicated above, the cutout filling mechanisms 200, 205 allow the pipe member 125 to occupy the cutouts 150, 155 in the table top portions 105, 110 when the extendable table 100 is contracted, and to cause the filler portions 160, 165 to occupy the cutouts 150, 155 when the extendable table 100 is extended. These cutout filling mechanisms 200, 205 are located under the table top portions 105, 110 proximate to the cutouts 150, 155, as indicated by the dashed lines in FIGS. 2 and 3.

Figure 5:
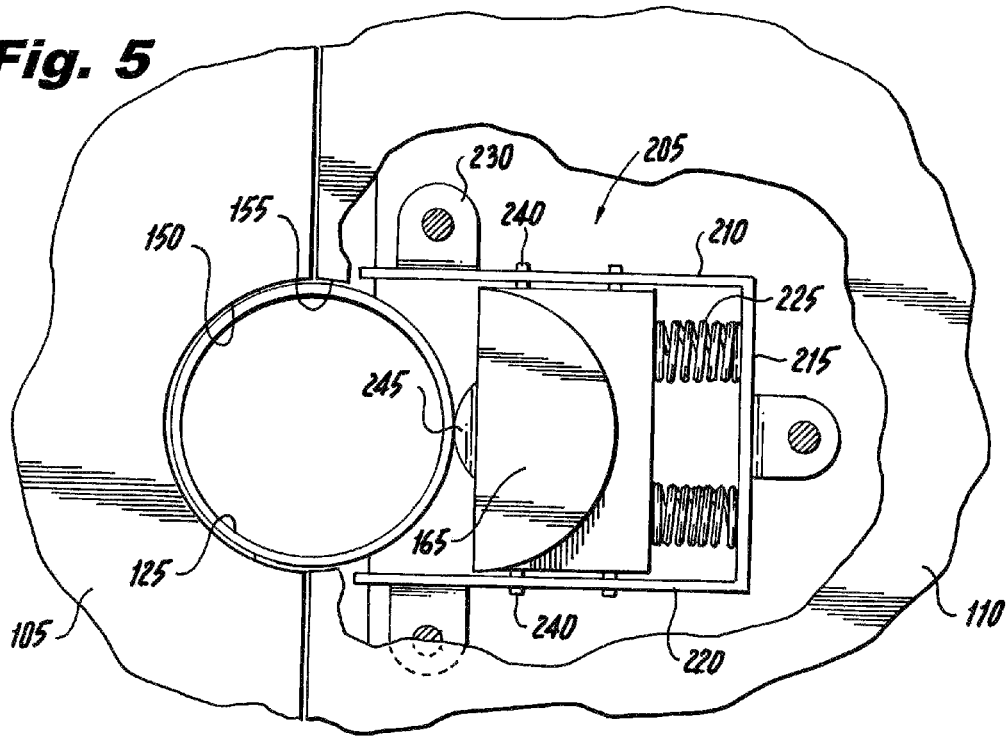
FIG. 5 shows a partially cutaway plan view of the FIG. 1 extendable table with one of its cutout filling mechanisms visible.
Figure 6:
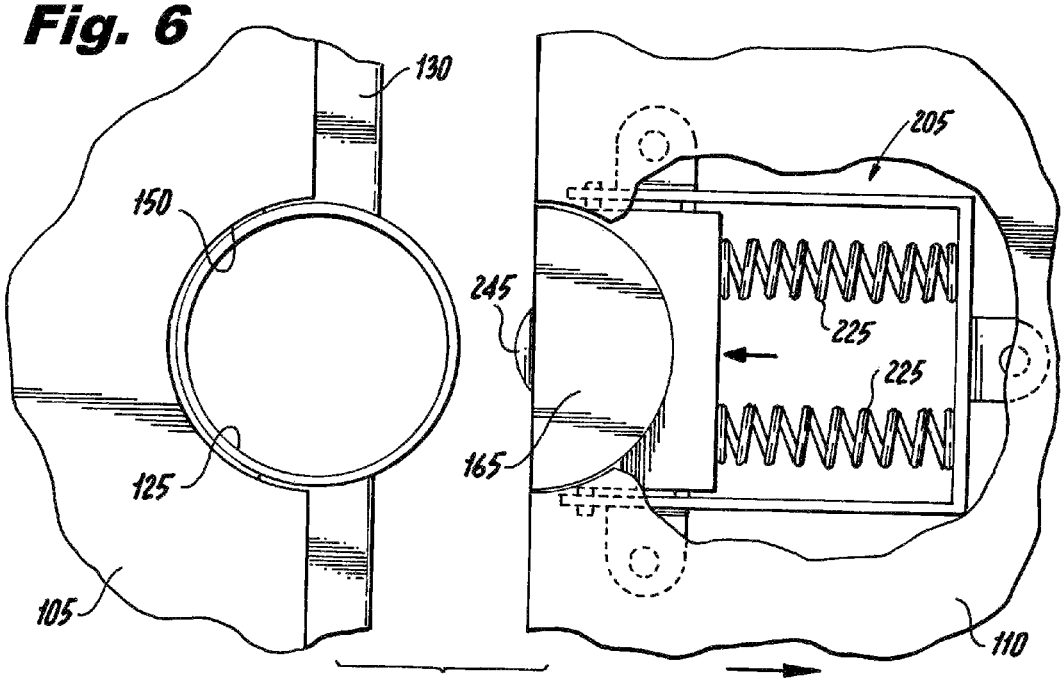
FIG. 6 shows another partially cutaway plan view of the FIG. 1 extendable table with the FIG. 5 cutout filling mechanism visible.

FIGS. 5-9 provide details about the components of the cutout filling mechanisms 200, 205, and the manner in which they function. Only the cutout filling mechanism 205 is described in detail because the other cutout filling mechanism 200 is largely identical to it. More particularly, FIGS. 5 and 6 show partially cutaway plan views of the extendable table 100 when the extendable table 100 is contracted and partially expanded, respectively. FIGS. 7 and 9, moreover, show perspective views of the cutout filling mechanism 205 in two different states, while FIG. 8 shows a sectional view of the filler portion 165 itself.

In addition to the filler portion 165, the cutout filling mechanism 205 comprises three sidewalls 210, 215, and 220; two springs 225; and three brackets 230. The filler portion 165 comprises a raised region that substantially conforms to the shape of the cutout 155 (in this particular example, a semicircle). The filler portion 165 is able to occupy two positions in the cutout filling mechanism 205: a retracted position (FIGS. 5 and 7), and a forward position (FIGS. 6 and 9). In the retracted position, the filler portion 165 is wholly outside the cutout 155 and occupies a space below the table top portion 110. In contrast, when in the forward position, the raised region of the filler portion 165 occupies the cutout 155 and substantially fills it.

The movement of the filler portion 165 between these two positions is directed by a set of substantially identical tracks 235 in the opposed sidewalls 210, 220 that act as guides (see FIGS. 7 and 9). Pins (or rollers) 240 protruding from the sides of the filler portion 165 occupy these tracks 235 and restrict the manner in which the filler portion 165 can move. When transitioning from the retracted position to the forward position, the tracks 235 cause the filler portion 165 to move forward and upward. When transitioning in the opposite direction, the tracks 235 cause the filler portion 165 to travel rearward and downward.

The forward and rearward movement (leftward and rightward movement, respectively, in FIGS. 5 and 6) of the filler portion 165 is driven or actuated by the pipe member 125 itself in combination with the springs 225. The springs 225 are dimensioned so that they bias the filler portion 165 in the forward direction. When the extendable table 100 is contracted and the pipe member 125 enters the cutout 155, the pipe member 125 contacts the filler portion 165 and pushes it rearward. This causes the springs 225 to compress. When the extendable table 100 is extended and the pipe member 125 leaves the cutout 155, the springs 225 push the filler portion 165 forward again. It will be noted that the filler portion 165 comprises a bumper 245 at its most forward edge. The purpose of the bumper 245 is to make contact with the pipe member 125 in order to avoid wear and tear on the remainder of the filler portion 165.

Notably, an alternative extendable table in accordance with aspects of the invention may forego the pipe member 125 altogether and simply allow a conventional umbrella pole to actuate the cutout filling mechanisms 200, 205. An extendable table 100' in accordance with a second illustrative embodiment of the invention is shown in partially cutaway plan view in FIG. 10. The extendable table 100' is identical to the extendable table 100 except for the fact that the extendable table 100' does not include the pipe member 125 or support brackets 130. Instead, an umbrella pole 300 passes through the center of the extendable table 100'. The umbrella pole 300 is supported by a conventional umbrella base 305 on the ground below the extendable table 100', and capped by a conventional umbrella (not explicitly shown).

Figure 10:
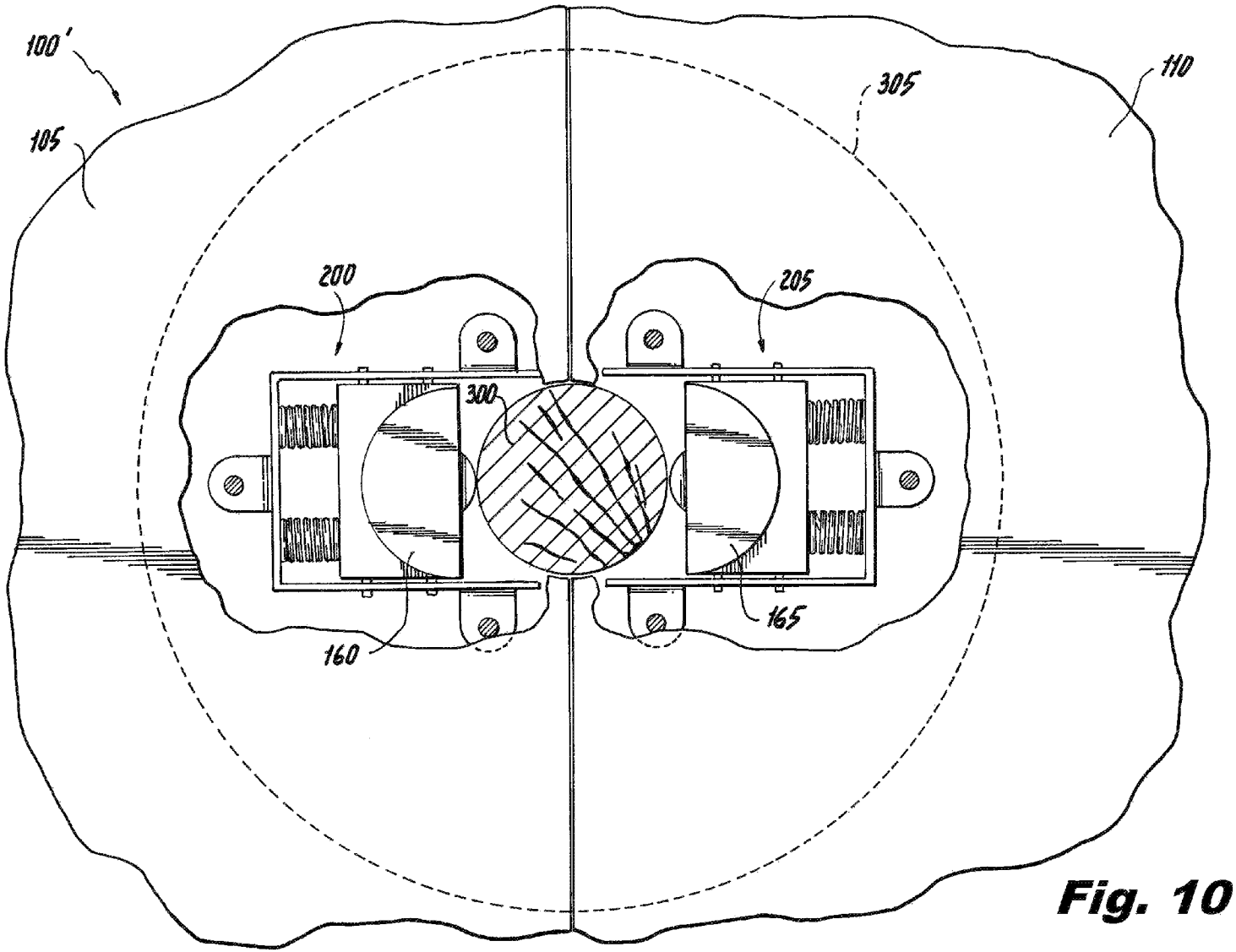
FIG. 10 shows a partially cutaway plan view of an extendable table in accordance with a second illustrative embodiment of the invention.

As configured as shown in FIG. 10, the forward and rearward movement of the filler portions 160, 165 is now actuated by the umbrella pole 300 rather than the pipe member 125. When the extendable table 100' is contracted and the umbrella pole 300 enters the cutouts 150, 155, the umbrella pole 300 contacts the filler portions 160, 165 and pushes them rearward. When the extendable table 100' is extended and the pipe member 300 leaves the cutouts 150, 155, the filler portions 160, 165 move forward again and occupy the cutouts 150, 155.

In this manner, both the extendable table 100 and the extendable table 100' are similarly operative to place portions of the filler portions 160, 165 into the cutouts 150, 155 when the cutouts 150, 155 are not occupied by another object, namely, the pipe member 125 or the umbrella pole 300, and to place the filler portions 160, 165 outside the cutouts 150, 155 when the cutouts 150, 155 are occupied by the pipe member 125 or the umbrella pole 300. Accordingly, in both embodiments, the cutouts 150, 155 are filled-in or "erased" when they are not needed to accommodate the central pipe member 125 or the umbrella pole 300.

Figure 11:
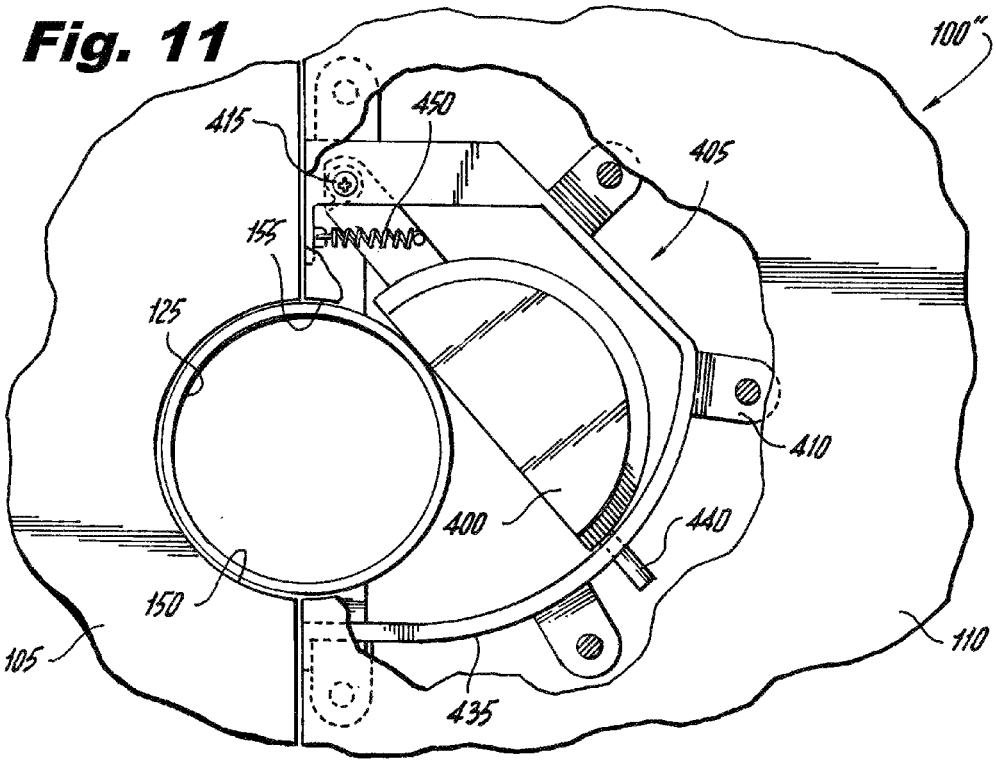
FIG. 11 shows a partially cutaway plan view of an extendable table in accordance with a third illustrative embodiment of the invention with one of its cutout filling mechanisms visible.
Figure 12:
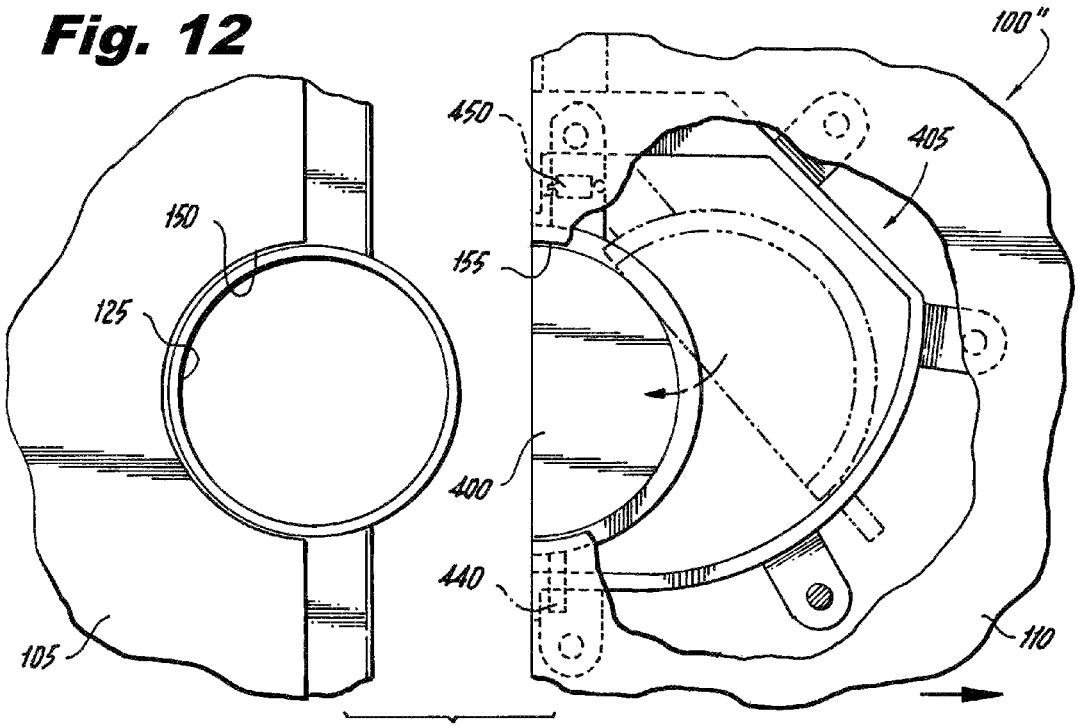
FIG. 12 shows another partially cutaway plan view of the FIG. 11 extendable table with the cutout filling mechanism visible.
Figure 13:
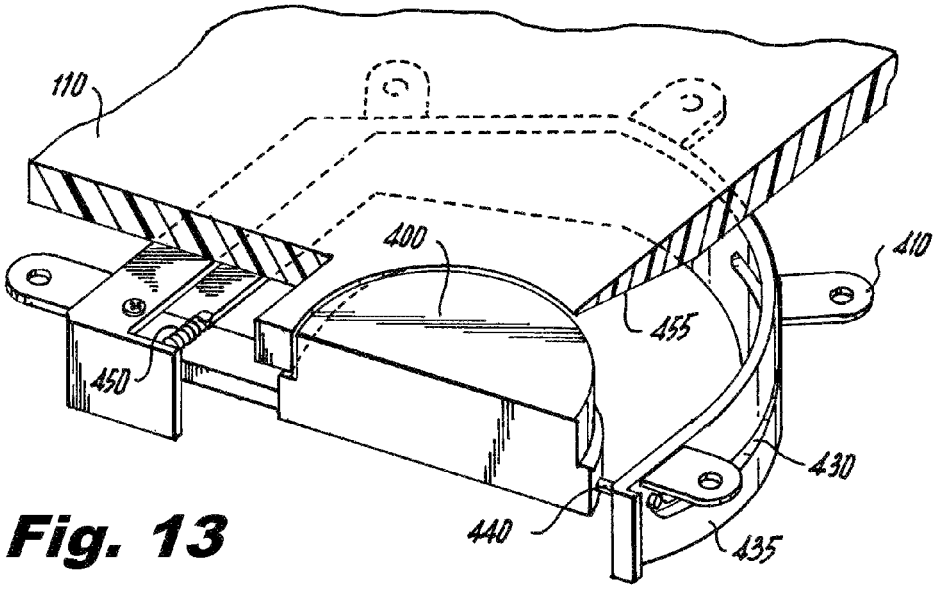
FIG. 13 shows a perspective view of the FIG. 11 cutout filling mechanism.
Figure 14:
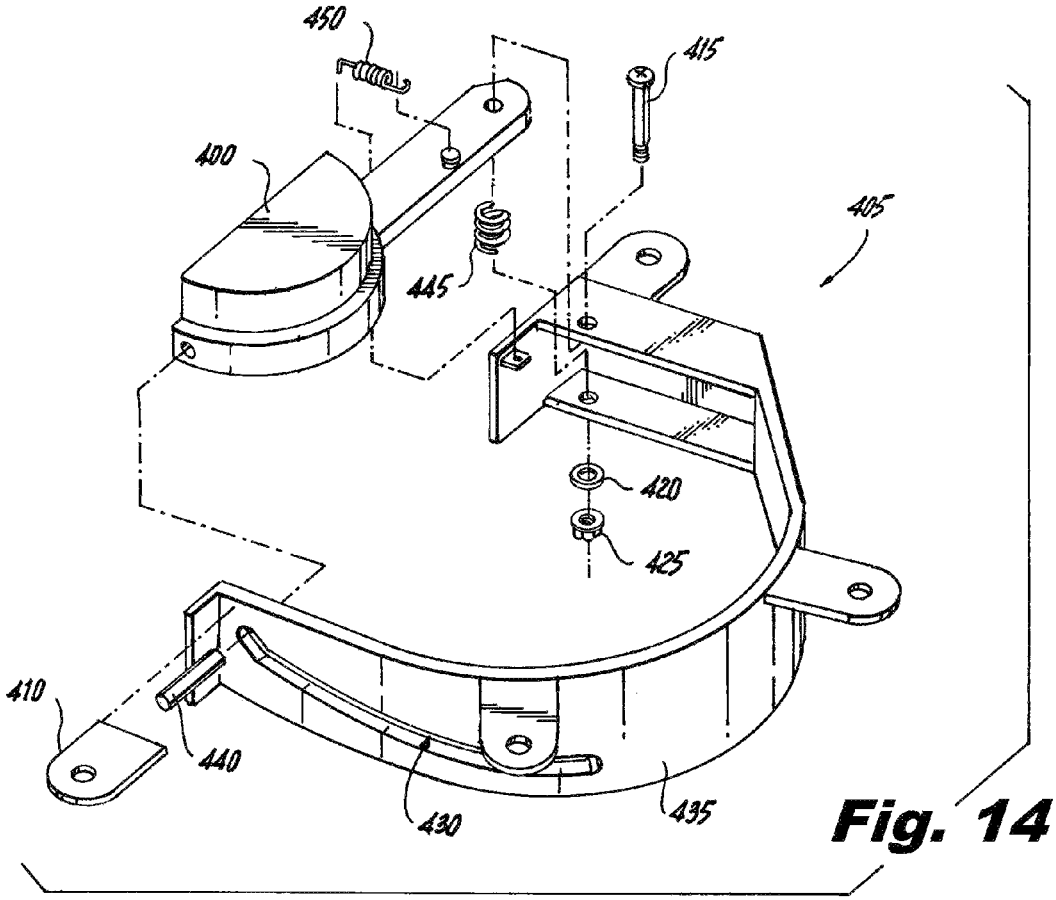
FIG. 14 shows an exploded view of the FIG. 11 cutout filling mechanism.

To even further illustrate aspects of the invention, FIGS. 11-14 go on to show details of an extendable table 100" in accordance with a third illustrative embodiment of the invention. FIGS. 11 and 12 show partially cutaway plan views, FIG. 13 shows a perspective view, and FIG. 14 shows an exploded view. In this particular embodiment, the extendable table 100" is identical to the extendable table 100 except that the extendable table 100" replaces filler portion 165 and cutout filling mechanism 205 in extendable table 100 with an alternative filler portion 400 and an alternative cutout filling mechanism 405, respectively.

Like the filler portion 165, the filler portion 400 is able to occupy two positions in the cutout filling mechanism 405: a retracted position (FIG. 11), and a forward position (FIGS. 12 and 13). In the retracted position, the filler portion 400 is wholly outside the cutout 155 and occupies a space below the table top portion 110. In contrast, when in the forward position, a raised region of the filler portion 400 occupies the cutout 155 and substantially fills it. Nevertheless, instead of having the cutout filling mechanism 405 cause the filler portion 400 to be translated without rotation relative to the table top portion 110 in the manner of the cutout filling mechanism 205 when changing positions, the cutout filling mechanism 405, instead, causes the filler portion 400 to be rotated or swung relative to the table top portion 110 in the manner of a swinging gate.

The cutout filling mechanism 405 is attached to the bottom of the table top portion 110 via several brackets 410. The movement of the filler portion 400 between the forward and retracted positions is directed by a rotation pin 415 with its associated washer 420 and nut 425, and a track 430 built into a sidewall 435. A pin 440 protruding from the side of the filler portion 400 occupies the track 430 and restricts the manner in which the filler portion 400 can move. When transitioning from the retracted position to the forward position, for example, the rotation pin 415 causes the filler portion 400 to rotate relative to the table top portion 110 while, at the same time, the track 430 causes the filler portion 400 to move upward. When transitioning in the opposite direction, the filler portion 400 rotates rearward while the track 430 causes the filler portion 400 to move downward.

The forward and rearward movement of the filler portion 400 is driven or actuated by the pipe member 125 itself in combination with a first spring 445 and a second spring 450. The first spring 445 biases the filler portion upward on the rotation pin 415, while the second spring 450 biases the filler portion 400 in the forward direction. When the extendable table 100" is contracted and the pipe member 125 enters the cutout 155, the pipe member 125 contacts the filler portion 400 and pushes it rearward. This causes the first spring 445 to compress and the second spring 450 to expand. When the extendable table 100" is extended and the pipe member 125 leaves the cutout 155, the first spring 445 pushes the filler portion 400 upward and the second spring 450 pulls the filler portion 400 forward again. In this manner, the cutout filling mechanism 405 is operative to place at least a portion of the filler portion 400 into the cutout 155 when the cutout 155 is not occupied by another object, and the cutout filling mechanism 405 is operative to place the filler portion outside the cutout 155 when the cutout is occupied by another object. In the present embodiment, that object is the pipe member 125, but it may also be an umbrella pole like the umbrella pole 300 in the manner of extendable table 100'.

Again returning to FIG. 13, it will be noted that the bottom of the table top portion 110 comprises a beveled surface 455 proximate to where the filler portion 400 travels between forward and retracted positions. This beveled surface 455 (or cammed surface) may help to guide the filler portion 400 when moving between positions. While shown in relation to the extended table 100", such a feature may be more generally applicable to all embodiments of the invention including the extended tables 100 and 100', if desired.

It should again be emphasized that the above-described embodiments of the invention are intended to be illustrative only. Other embodiments can use different types and arrangements of elements for implementing the described functionality. For example, only a very rudimentary system for slidably attaching the table top portions 105, 110 to the frame 115 of the extendable tables 100, 100', 100" is described herein, and numerous alternative embodiments within the scope of the appended claims for accomplishing this function will be apparent to one skilled in the art. Moreover, the above-described embodiments assume that one or more additional table leaves are manually added to the extendable tables 100, 100', 100" when the tables are extended. Nevertheless, it is contemplated that designs within the scope of the invention might utilize mechanisms that automatically insert the additional leaves into the extendable tables by, for example, lifting the leaves from a position below the extendable tables as their table top portions are moved. Lastly, the means for supporting the outdoor umbrella in the above-described extendable tables 100, 100" is simply a cylindrical tube that allows an umbrella pole to pass through it (i.e., the pipe member 125). In alternative embodiments, the umbrella support may be any apparatus on which an umbrella pole may be vertically mounted including, but not limited to, a vertically mounted cylindrical tube with a closed or partially closed lowermost end on which the pole of the umbrella may rest. An optional set-screw threaded through the cylindrical tube and exerting compressional force on the umbrella pole within the tube may further add stability to the umbrella. The need for a conventional umbrella base that sits under the extendable table like the umbrella base 305 in FIG. 10 is thereby eliminated.

Again, these numerous alternative embodiments within the scope of the appended claims will be apparent to one skilled in the art. Moreover, all the features disclosed herein may be replaced by alternative features serving the same, equivalent, or similar purposes, unless expressly stated otherwise. Thus, unless expressly stated otherwise, each feature disclosed is one example only of a generic series of equivalent or similar features.

What is claimed is:

1. An extendable table, the extendable table comprising:

a frame;

a first table top portion, the first table top portion being slidably attached to the frame and defining a first cutout;

a first cutout filling mechanism, the first cutout filling mechanism attached to the first table top portion and comprising a first filler portion;

a second table top portion, the second table top portion being slidably attached to the frame, defining a second cutout, and being positionable so as to abut the first table top portion such that the second cutout joins with the first cutout; and a second cutout filling mechanism, the second cutout filling mechanism attached to the second table top portion and comprising a second filler portion;

wherein the first cutout filling mechanism is operative to place at least a portion of the first filler portion into the first cutout when the first cutout is not occupied by another object, and the first cutout filling mechanism is operative to place the first filler portion outside the first cutout when the first cutout is occupied by another object;

wherein the second cutout filling mechanism is operative to place at least a portion of the second filler portion into the second cutout when the second cutout is not occupied by another object, and the second cutout filling mechanism is operative to place the second filler portion outside the second cutout when the second cutout is occupied by another object.

2. The extendable table of claim 1, further comprising:

a pipe member attached to the frame proximate to a center of the extendable table;

wherein the first table top portion is positionable so that the pipe member substantially occupies the first cutout, and the first table top portion is also positionable so that the pipe member is outside the first cutout.

3. The extendable table of claim 2, wherein the pipe member is mounted substantially normal to an uppermost surface of the first table top portion.

4. The extendable table of claim 1, further comprising:

an outdoor umbrella having an umbrella pole;

wherein the first table top portion is positionable so that the umbrella pole substantially occupies the first cutout, and the first table top portion is also positionable so that the umbrella pole is outside the first cutout.

5. The extendable table of claim 1, wherein the second table top portion is substantially a mirror image of the first table top portion.

6. The extendable table of claim 1, wherein the first filler portion substantially fills the first cutout when the first cutout is not occupied by another object.

7. The extendable table of claim 1, wherein the first filler portion has an upper surface that is substantially flush with an upper surface of the first table top portion when the first cutout is not occupied by another object.

8. The extendable table of claim 1, wherein the first cutout filling mechanism is actuated at least in part by placing or relieving contact pressure on the first filler portion.

9. The extendable table of claim 1, wherein the first filler portion is positioned below the first table top portion when the first cutout is occupied by another object.

10. The extendable table of claim 1, wherein the first cutout filling mechanism comprises a guide, and wherein movement of the first filler portion is restricted by the guide.

11. The extendable table of claim 1, wherein the first cutout filling mechanism comprises one or more pins or rollers.

12. The extendable table of claim 1, wherein the first cutout filling mechanism comprises one or more springs adapted to bias the first filler portion towards a position wherein at least part of the first filler portion is in the first cutout.

13. The extendable table of claim 1, wherein the first cutout filling mechanism allows the first filler portion to be translated without rotation relative to the first table top portion.

14. The extendable table of claim 1, wherein the first cutout filling mechanism allows the first filler portion to be raised and lowered relative to the first table top portion.

15. The extendable table of claim 1, wherein the first cutout filling mechanism allows the first filler portion to be rotated relative to the first table top portion.

* * * * *